United States Patent [19]

Mitchell

[11] Patent Number: 4,825,728

[45] Date of Patent: May 2, 1989

[54] POP-TOP CAN OPENER RING

[76] Inventor: Edward G. Mitchell, 55 Kingston Rd., Plaistow, N.H. 03865

[21] Appl. No.: 232,625

[22] Filed: Aug. 15, 1988

[51] Int. Cl.[4] ..... B67B 7/44

[52] U.S. Cl. ..... 81/3.09; 81/3.55; 63/1.1

[58] Field of Search ..... 81/3.55, 3.4, 3.09, 81/3.07; 63/1.1

[56] References Cited

U.S. PATENT DOCUMENTS

| | | | |
|---|---|---|---|
| 2,441,947 | 5/1948 | Welch | 132/1 |
| 2,614,878 | 10/1952 | Ziemke | 294/16 |
| 4,253,352 | 3/1981 | O'Neal | 81/3.46 R |
| 4,466,313 | 8/1984 | Gardner | 81/3.46 R |
| 4,530,260 | 7/1985 | Holka | 81/3.55 |
| 4,660,446 | 4/1987 | Soltis | 51/3.55 |
| 4,667,544 | 5/1987 | Milo | 81/3.09 |

FOREIGN PATENT DOCUMENTS

| | | | |
|---|---|---|---|
| 2404602 | 8/1974 | Fed. Rep. of Germany | 81/3.55 |

*Primary Examiner*—Roscoe V. Parker
*Attorney, Agent, or Firm*—I. C. Waddey, Jr.

[57] ABSTRACT

A finger ring having a decorative jewelry appearance but having integrated with the body structure of the ring a utilitarian structure that can be used to lift the tab of a tab-top or pop-top container. The structure of the ring includes a ring body which is circular or oval in shape with at least one arcuate segment of the ring body having a cross-section, when taken perpendicular to the plane of the ring, which includes a shoulder portion of the ring body connected to a tab opener lip by a neck portion of the ring body, the neck portion of the ring body forming the upper surface of the ring to form a lip which extends in the direction of the axis of the ring for use in opening pop-top or tab-top containers.

7 Claims, 1 Drawing Sheet

POP-TOP CAN OPENER RING

The present invention relates to devices designed to facilitate the opening of tab-top containers, and more particularly relates to a finger ring which includes an integral structural design that allows the wearer of the ring to readily and easily lift the tab on a pop-top container by use of the structure of the ring without having to adjust the position or location of the ring on his or her finger while at the same time avoiding cuts, torn fingernails, and frustration generally associated with the opening of tab-top containers.

As is well documented, tab-top containers are a primary method of distributing beverages for the immediate and direct consumption by the purchaser. Soft drinks, ice tea, lemonade, beer, and fruit juices are only a few of the beverages that are distributed in tab-top containers ready for immediate consumption by the purchaser. The success of these tab-top containers for distribution of beverages is well documented and there function and operation is universally known. The top of the container contains a pouring spout which is sealed by a portion of the top that is connected to the remainder of the top by a weakened tear line. A lever mechanism is connected to the spout portion of the top and generally lays flat against the top of the container. This lever mechanism is lifted and tears the spout portion of the can causing it to be depressed into the can and opens the spout so that the beverage can be consumed by the purchaser.

Because the lever mechanism of the tab-top container lies flat against the top and must be raised to create the pressure to open the container, the structure of the tab-top requires that it be firmly connected to the container. Generally the user has to place his or her finger under the end of the lever to raise it and because the lever is securely fastened to the top, depending upon the structure of the lever, it can injure the finger of the user as he or she raises the tab to open the tab-top container. Injury from devices of this nature, while not normally serious, can be particularly aggravating and most often occur when the consumer, for one reason or another, has to open a large number of cans on any given occasion. Party hosts, bartenders, and others have suffered these aggravating injuries through use of the tab-top containers, with the injuries ranging from cut fingers to torn fingernails, and the like.

Historically, efforts to avoid the problem of injuries while opening tab-top containers have been dealt with by attempting to design the lever mechanism of the tab-top in a way to eliminate sharp edges. Rings have been used as the lever mechanism in order to smooth out the edge of the lever, as well as folding and smoothing the metal portion of the lever to avoid abrasion of the consumer's finger. These measures and attempts to avoid injuries to the consumer when using a tab-top container are commendable but not totally effective.

Others have attempted to deal with this problem by designing opener mechanisms that can be used by the consumer so that the consumer does not have to use his or her finger to lift the lever on the tab-top container.

Inventions of the type just referred to include those disclosed in the patents to O'Neal, U.S. Pat. No. 425,352, to Holka, U.S. Pat. No. 4,530,260, and to Soltis, U.S. Pat. No. 4,660,446. The inventions of the patents just referred to, however, are such that they can be lost or easily misplaced. While the inventions do function for their intended purpose, the consumer must keep up with the device in order to have it handy whenever he or she wants to open a tab-top container, and the devices are easily misplaced.

Other inventions directed at this problem include thimble-type devices as disclosed in the patent to Gardner, U.S. Pat. No. 4,466,313. Once again, however, these type devices can be easily misplaced and are not really available when needed. Similarly, the invention disclosed in the patent to Milo, U.S. Pat. No. 4,667,544, which is a ring-type structure, is not designed to be worn in the normal fashion of a ring, and while it does have a ring shape, it is different from the device of the present invention in the manner in which it is used and its functionality.

Accordingly, a need exists for a device that will effectively enable a consumer to open a tab-top container without injuring himself or herself, or at least minimizing the risk of injury, yet is less likely to be misplaced, and which, when used, can be used with a minimum amount of effort and wasted motion.

The present invention meets the above needs and others and accordingly, in its preferred form includes a finger ring to be worn in the normal fashion on the ring finger or other finger of a consumer and which for all practical purposes appears to be simply a decorative piece of jewelry. The structure of the ring, however, includes a lip along at least one arcuate portion of the ring which lip is formed by a shoulder of the ring body connected to an upper surface of the ring by a reduced neck portion of the ring so that the lip extends both toward the tip of the finger and toward the hand when the ring is worn, thus the lip extends in the direction of the axis of the ring. The upper surface of the ring can be a decorative piece of jewelry, such as a signet ring, or alternatively, the upper surface of the ring can be used as a part of a promotional scheme by embossing it with the logo of beer, soft drinks, or other beverages. The ring of this invention, when distributed to consumers, can thus serve as a decorative jewelry piece by including an engraved or jeweled surface or in the case of a promotional device, including upon the surface portion a logo or other insignia of a trademarked product.

In accordance with another aspect of the invention, the lip portion of the ring can be engaged simply against the lever mechanism of a tab-top container in one of two ways: first, if the container is held in the normal fashion with its tab-top portion of the can up, if the ring is worn in the normal fashion with the display surface on top of the finger, the consumer simply turns his or her hand over so that the palm is facing upwardly and engages the lip of the ring against the tab and raises the tab by flexing his or her wrist; secondly, the consumer could simply rotate the ring on his or her finger so that the decorative surface is facing in the same direction of the palm of his or her hand and simply places his or her hand palm down on top of the tab-top container and engages the lip of the ring against the lever mechanism and raises it by raising his or her hand. By having the lip extending in both directions on the ring, no matter which direction that tab is facing when the consumer picks up the container, it can readily engage by the lip of the ring.

The above aspects and advantages of the invention will be readily appreciated by those of ordinary skill in the art as the same becomes understood by reference to the following detailed description of the preferred embodiment when considered in conjunction with the accompanying drawings in which.

Figure 1:
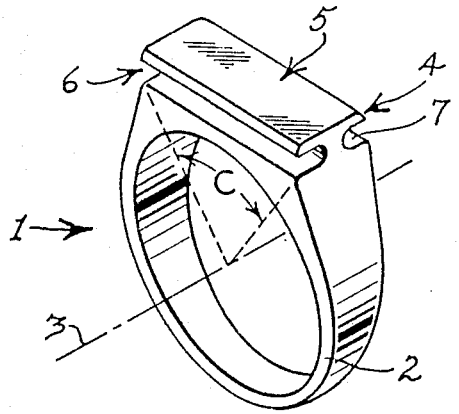
FIG. 1 is a perspective view of the ring which comprises the invention in its preferred embodiment.
Figure 3:
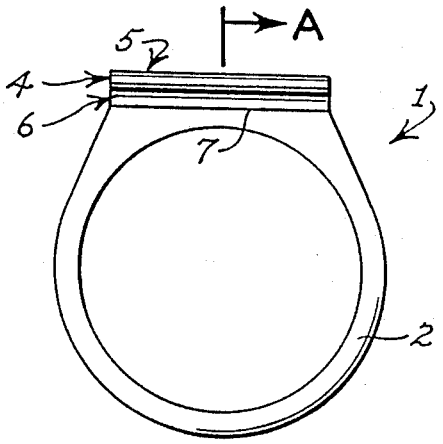
FIG. 3 is a view of the ring looking in the direction of the axis of the ring of this invention.
Figure 2:
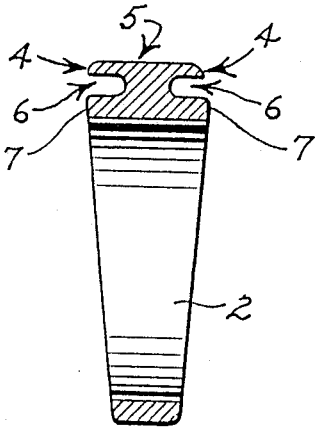
FIG. 2 is a cross-section of the ring shown in FIG. 1, taken along the lines AA.

Referring now to the drawings in which like reference characters refer to like or similar parts throughout the several views, a ring 1 is shown having a ring body 2 which is circular or oval generally when viewed in the direction of the axis of the ring 3.

The ring body 2 has at least an arcuate portion C thereof which is structured to provide a tab lifter for tab-top containers. The tab lifter is the form of a lip 4 which is formed by the joinder of an upper surface 5, which is essentially flat and contains the decorative or promotional portion of the ring, and the neck portion 6 of the ring.

The surface 5, which is an integral part of the ring, can be bejeweled or engraved in order to enhance the beauty of the jewelry, or it may contain the logo or other trade emblem of a beverage distributor or the like in order to promote the distributor's product.

The lip 4 is formed by the connection of the neck portion 6 of the ring as it meets the upper surface 5, forming a lip which is perpendicular to the axis of the ring. The neck portion 6 is of a narrower width than the width of the upper surface 5 (preferably approximately one-eighth ($\frac{1}{8}$) inch for the neck and one-fourth ($\frac{1}{4}$) inch for the width of the upper surface), and the portion of the neck opposite the upper surface is integral with the ring body forming a shoulder 7 which is integral with the ring body and of approximately the same width as the upper surface 5.

In the preferred embodiment of the invention, the width between the shoulders 7 of the ring and the two lips 4 of the upper surface 5 of the ring is approximately the same so that the shoulders of the ring do not create an interference with the ability to slip the lip of the ring under a tab of a tab-top container. The neck portion 6 of the ring is narrower than the width between the shoulders 7 and lips 4 so as to form, in conjunction with the upper surface 5 and lips 4 to facilitate the opening of tab-top containers.

Figure 4:
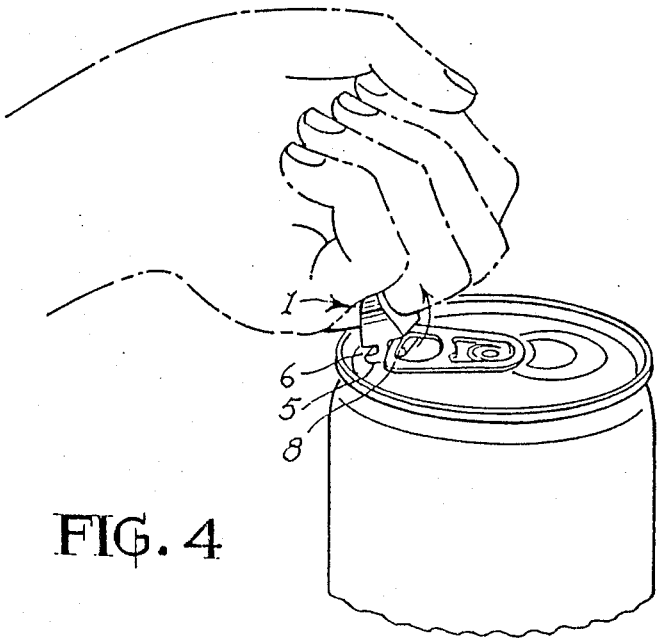
FIG. 4 shows the ring being used in one manner to open the tab of a tab-top container.

In operation, as can be seen from FIG. 4, with the ring on the consumer's finger in the normal position of a ring with the decorative surface facing in the direction of the back of the hand, the consumer simply turns his or her hand palm up and inserts the lip 5 of the ring beneath the tab 8 of a tab-top container and flexes his or her finger upwardly in order to lever the tab up so that it can depress the tab-top and open the container without any injury such as a cut or abrasion occurring to the consumer. Similarly, the consumer can simply rotate the ring about his or her finger so that the surface 5 of the rig is facing the same direction as the palm of the hand. The consumer then places his or her hand on top of the tab-top container with the palm covering the top of the container and inserting the lip 5 of the ring beneath the tab and raising the finger in order to raise the tab without cutting or abraiding the consumer's hand.

As can be seen from the preferred embodiment of this invention, because the ring has a lip in both directions, that is to say when the ring is on a consumer's finger, there is a lip facing in the direction of the fingernail as well as a lip facing in the direction of the wrist. Thus, the ring can be used very rapidly to open tab-top containers regardless of the direction in which the tab-top is facing. This facilitates ease of use of the invention for those people such as bartenders who use the device repeatedly and who want to be able to quickly open the tab-top beverage container without injury to themselves.

The preferred embodiment of this invention has been illustrated and described in the foregoing detailed description, and it will be understood by those of ordinary skill in the art that the device is capable of numerous rearrangements, substitutions, and modifications without departing from the scope and spirit of the claims as set forth below. For example, the upper surface 5 can be reshaped in a number of ways provided that it joins with the neck portion of the ring to create an axially extending lip that can be inserted beneath the lever of a tab-top container. The advantages of the invention can be readily seen, however, since the ring is not likely to be lost or misplaced, and it can be readily used without taking it off the finger or adjusting its location on the finger. There is no need to remove the ring or relocate it to another position on the hand, thus reducing the risk of losing the device which is the subject matter of the invention.

Having particularly described the preferred embodiment of my invention, what is claimed is:

1. A ring to be worn by a consumer and to be used to open tab-top containers while minimizing the risk of cuts or abrasions to the consumer, comprising:

a ring body which includes an arcuate section of at least a portion thereof which includes a shoulder of approximately the same width as the ring body, an upper surface having a width of approximately the same width as the shoulder of the ring body, the upper surface being connected to the shoulder by a narrower neck portion, the joinder of the neck portion and the upper surface forming a lip running perpendicular to the axis of the ring.

2. The device of claim 1 wherein the upper surface of the ring contains a logo or other advertising insignia.

3. The device of claim 1 wherein the arcuate portion of the ring extends a full 360 degrees.

4. The device of claim 1 wherein the width of the upper surface is at least one-quarter inch.

5. The device of claim 1 wherein the width of the shoulder is the same at the width of the upper surface.

6. The device of claim 1 wherein the width of the neck portion is no greater than one-eighth inch.

7. A ring to be worn by a consumer and to be used to open tab-top containers while minimizing the risk of cuts or abrasions to the consumer, comprising: a ring body which includes an arcuate section of at least a portion thereof which includes shoulders of approximately the same width as the ring body, an upper surface having a width of approximately the same width as the shoulders of the ring body, the upper surface being connected to the shoulders by a narrower neck portion, the joinder of the neck and the upper surface forming lips running perpendicular to the axis of the ring, said lips being on both sides of the ring such that when the ring is placed on the finger of a consumer, the lip closest to the wrist of the consumer is pointing in the direction of the wrist and the lip closest to the fingernail of the consumer is pointing in the direction of the fingernail of the consumer.

* * * * *